US005870059A

United States Patent [19]

Reynolds

[11] Patent Number: 5,870,059

[45] Date of Patent: Feb. 9, 1999

[54] ANTENNA MAST WITH LEVEL INDICATING MEANS

[75] Inventor: Kevin T. Reynolds, Plano, Tex.

[73] Assignee: MCI Worldcom, Inc., Ga.

[21] Appl. No.: 784,109

[22] Filed: Jan. 15, 1997

[51] Int. Cl.[6] ..... H01Q 3/00

[52] U.S. Cl. ..... 343/760; 343/894

[58] Field of Search ..... 343/760, 878, 343/880, 881, 882, 894, 765, 766; H01Q 3/00

[56] References Cited

U.S. PATENT DOCUMENTS

| | | | |
|---|---|---|---|
| 3,510,877 | 5/1970 | Turriere | 343/760 |
| 4,126,865 | 11/1978 | Longhurst et al. | 343/894 |
| 4,689,635 | 8/1987 | Haupt | 343/894 |

FOREIGN PATENT DOCUMENTS

| | | | |
|---|---|---|---|
| 0062202 | 4/1984 | Japan | 343/894 |
| 0158103 | 9/1984 | Japan | 343/894 |

*Primary Examiner*—Don Wong
*Assistant Examiner*—Tho Phan

[57] ABSTRACT

An antenna mounting system including at least one level indicating device mounted on a mast of the antenna for providing a constant indication of the alignment of the mast relative to a selected orientation of the mast with respect to the horizon.

4 Claims, 8 Drawing Sheets

Side View

Side View

ANTENNA MAST WITH LEVEL INDICATING MEANS

FIELD OF THE INVENTION

This invention relates to means for establishing and maintaining alignment of terrestrial antennas for receiving and/or transmitting electromagnetic radiation.

BACKGROUND OF THE INVENTION

When installing a terrestrial satellite antenna (TSA), the base and/or mast of the antenna must be accurately aligned relative to the horizon in order to facilitate alignment of the antenna dish mounted on the mast with an orbiting satellite. For example, when the base is mounted on the ground, it is generally preferable to align the mast perpendicular to the horizon. Similarly, if the base is mounted on a vertical structure such as a wall, it is generally preferable for the mast to be oriented parallel to the horizon. In the past, proper installation of a TSA required the services of a skilled installer utilizing a variety of leveling tools to ensure optimal mast orientation. As a result, customers and other novices were often discouraged from installing and aligning such antennas.

Moreover, after the initial installation of a TSA, its orientation may shift due to a variety of causes, such as impact with external objects, strong winds, ground settling, and the like. Therefore, realignment of the mast of a TSA is required from time to time. The novice is then faced with the choice of attempting a complicated alignment procedure, or hiring a costly installer to realign the TSA. More likely, the novice simply lets the orientation of the antenna continue to stray with ever degenerating equipment performance.

In response to the problems faced by the novice installer, several prior devices have been proposed for aiding the alignment of terrestrial satellite antennas (TSA's). For example, U.S. Pat. No. 4,495,706 to Kaminski discloses an alignment gauge which uses a pendulum and compass to indicate the azimuth and elevation angles for orienting an antenna receiving dish. U.S. Pat. No. 4,237,465 to Shibano et al. discloses a map plate having polar coordinates for use with a pendulum styled pointer to adjust the angle of elevation of an antenna dish.

U.S. Pat. No. 5,274,926 to Dillon discloses an instrument for aiming an antenna on the earth's surface toward an antenna on a satellite in geostationary orbit about the Earth. The instrument is said to include a bubble level (not shown) to align a sphere showing a map such that a line through the center of the bubble and the center of the sphere will be aimed at the center of the earth.

SUMMARY OF THE INVENTION

A principal object of the present invention is to provide an antenna system for a terrestrial satellite antenna (TSA) wherein the mast may be easily installed, aligned and maintained by a novice installer or the purchaser.

Another object of the invention is to provide an antenna system for a TSA wherein the mast may be easily realigned from time to time.

A further object of the invention is to provide a quick and easy visual indication of when the mast of a TSA is in or out of alignment.

The present invention provides these and other features in a TSA apparatus using one or more level indicating means that may be incorporated directly within the mast housing to indicate a one or two dimensional tilt of the TSA mast with respect to the horizon, regardless of the natural orientation of the surface on which the TSA is mounted. Irrespective of whether the TSA mast is aligned with an axis parallel to the horizon or perpendicular to the horizon (i.e., a vertical axis), the selected orientation is considered to be relative to the horizon.

BRIEF DESCRIPTION OF THE DRAWINGS

A more complete understanding of the present invention can be obtained by considering the following detailed description in conjunction with the accompanying drawings, in which.

DETAILED DESCRIPTION OF THE PREFERRED EMBODIMENTS

Figure 1A:
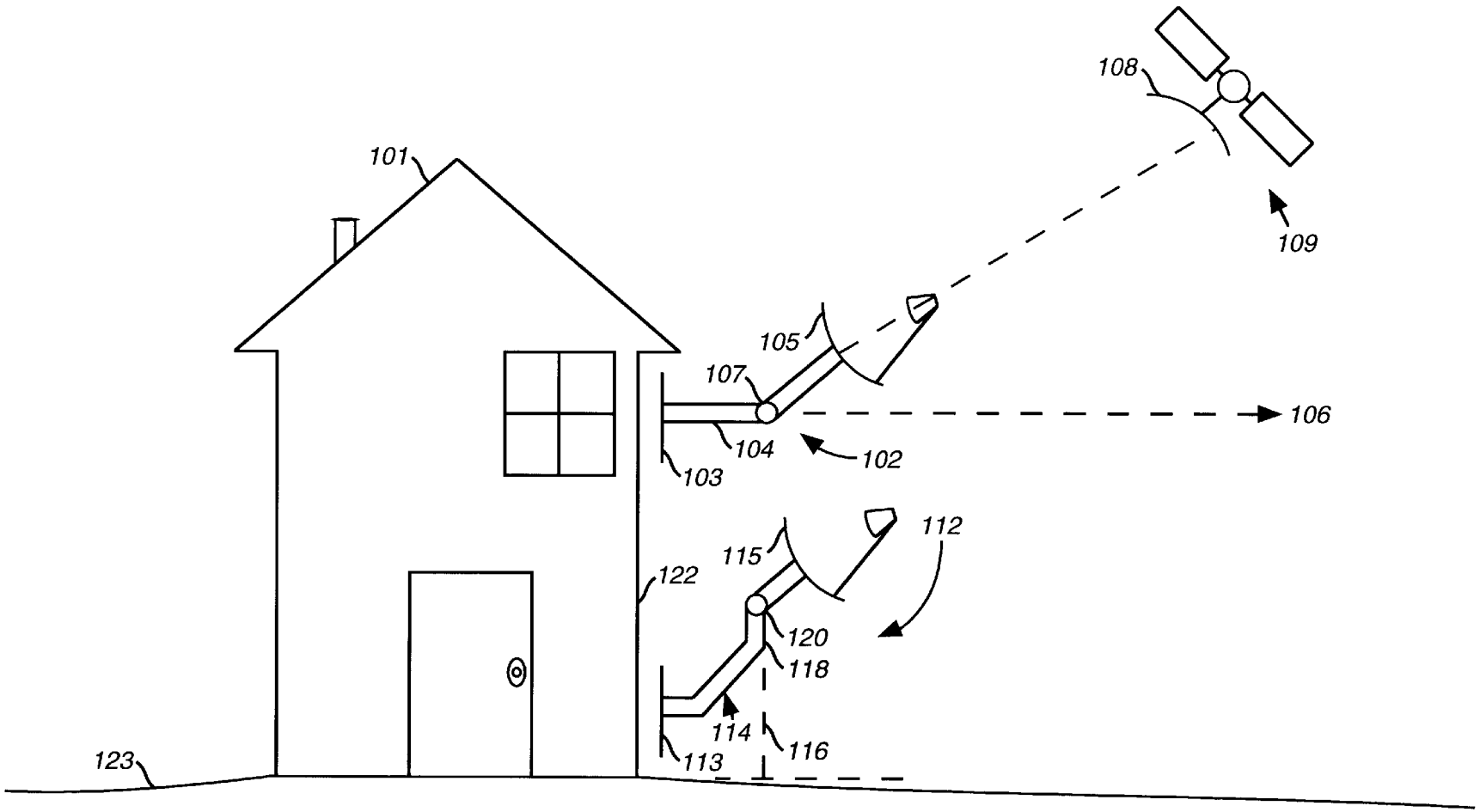
FIG. 1A is an elevational view showing a TSA mounted on a generally vertical surface in two possible orientations.

FIG. 1A illustrates a terrestrial satellite antenna (TSA) 102, which is in communication with a satellite 109 and mounted on a vertical surface, such as wall 122 of house 101. TSA 102 comprises a base portion 103, a mast 104 and a parabolic receiver assembly 105 connected to mast 104 via an adjustable means, such as an adjustable elbow connection 107, for positioning the dish of the receiver assembly relative to an antenna dish 108 of the satellite 109. For the arrangement shown, it is generally preferable that TSA mast 104 be aligned parallel to the horizon, as indicated by horizontal axis 106 which is shown generally parallel to the ground 123.

FIG. 1A also depicts a second TSA 112 having a base 113 and a mast 114, wherein the mast has a distal section 118 designed to be mounted perpendicular to the horizon along a vertical axis, as indicated by broken line 116. Here also, it is generally preferable for mast section 118 to be aligned precisely with vertical line 116 in order to facilitate orientation of a parabolic receiving assembly 115 with the antenna dish 108 of satellite 109. Mast section 118 is connected to the parabolic receiver assembly 115 via an adjustable elbow 120 for positioning the receiver dish relative to satellite 109.

Figure 1B:
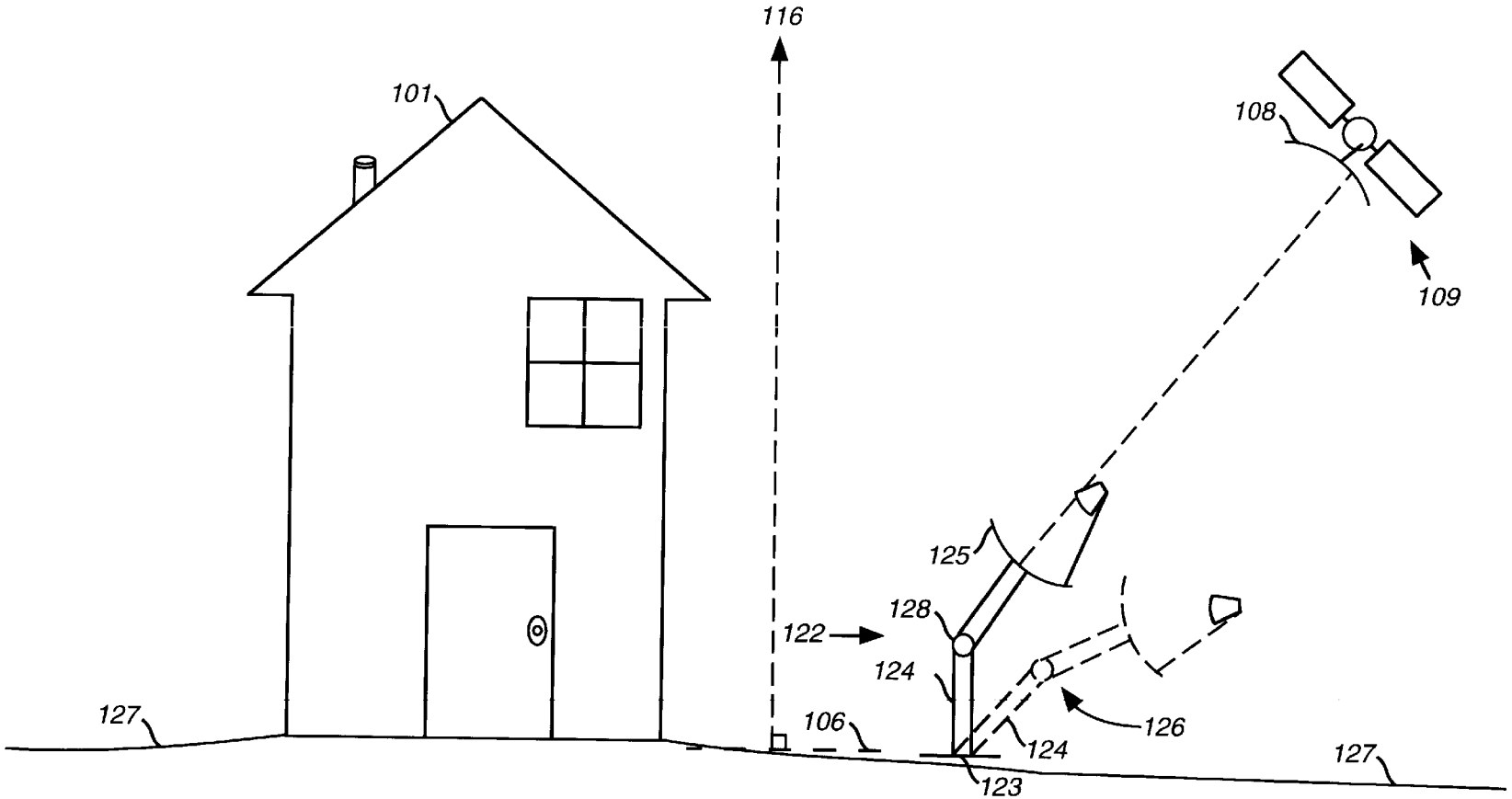
FIG. 1B is an elevational view showing a TSA mounted on a generally horizontal surface and illustrating when it is in and out of alignment.

FIG. 1B illustrates a TSA 122, which is mounted on the ground 127. TSA 122 includes a base portion 123, a mast 124 and a parabolic receiver assembly 125 connected to mast 124 by an adjustable means, such as an elbow connection 128. The adjustable means is used to position the parabolic receiver assembly for the best reception from transmitter antenna 108 of satellite 109. This adjustment is best facilitated when mast 124 is perpendicular to the horizon along the vertical axis 116. A condition of poor alignment of mast 124 is indicated by broken lines in FIG. 1B.

Figure 1C:
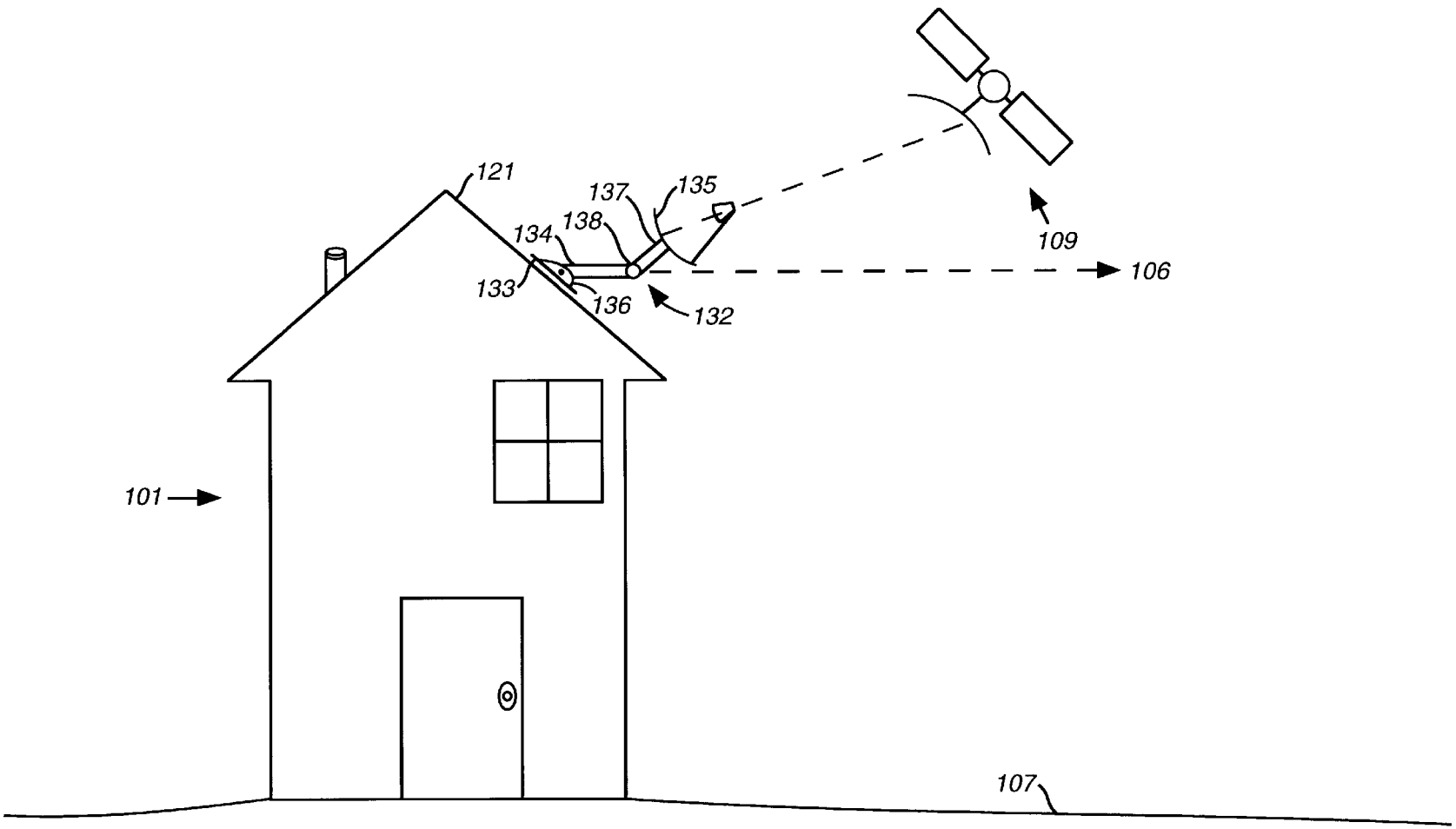
FIG. 1C is an elevational view showing a TSA mounted on an angled surface.

FIG. 1C depicts a TSA 132 mounted on a surface having an arbitrary angle relative to the horizon, such as might occur when mounted on a roof 121 of the house 101. As shown, proper alignment of the parabolic receiving assembly 135 with the satellite 109 is facilitated when the TSA mast 134 is aligned with the horizon as represented by broken line 106. In this case, mast 134 is designed to be adjusted at an arbitrary angle relative to the base 133 by an adjustable bracket 136, enabling mounting on any surface at an angle to the horizon 107. Assembly 135 is connected to mast 134 via an arm 137 and an adjustable elbow 138. Elbows 107, 120, 128 and 138 are shown as universal connections, although they may be bidirectional if satellite dish 108 may be otherwise aligned in a common plane with the parabolic dish of the receiving assembly.

Figure 2B:
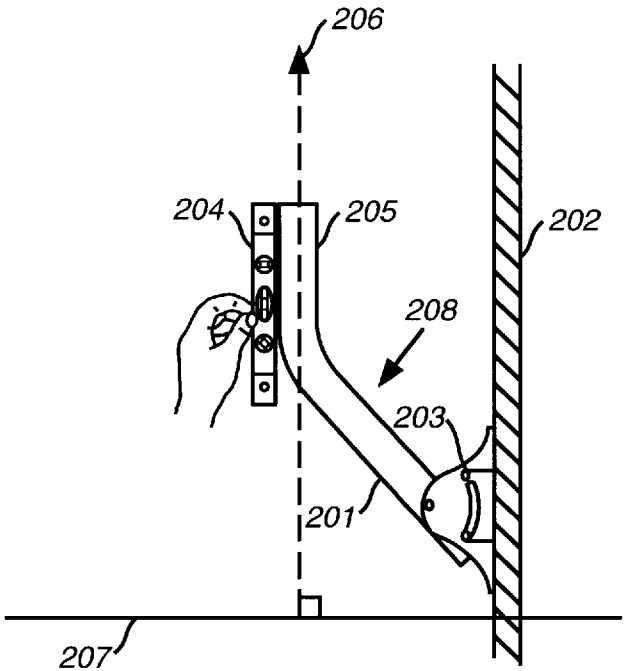
Prior Art FIG. 2(b)
FIGS. 2A and 2B illustrate a prior art method of aligning a TSA in a first degree of freedom, and show the mast out and in alignment, respectively.
Figure 2A:
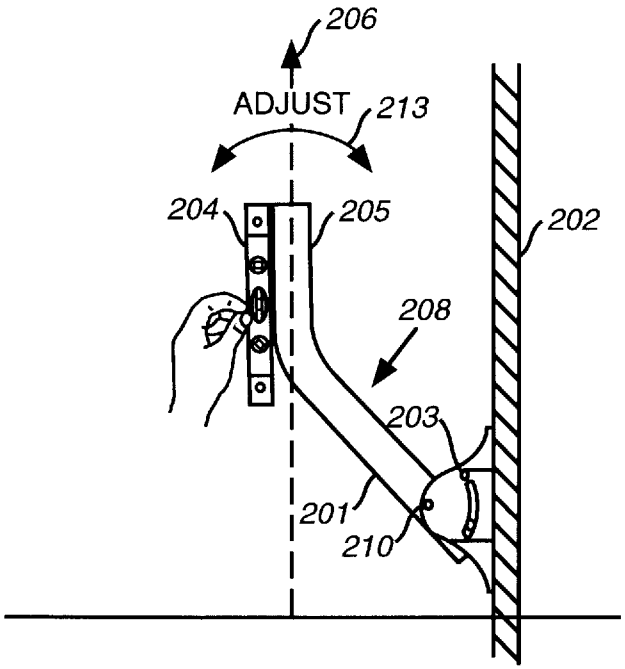
Prior Art FIG. 2(a)

Figs. 1A–1C therefore show desired orientations for the TSA mast when the TSA is mounted on a variety of surfaces. The problem addressed by the present invention is how to effectively carry out the orientation process. Prior art methods to effect the orientation, as shown in FIGS. 2A–3C have all relied on external alignment instruments and a complicated alignment procedure. For example, FIGS. 2A and 2B illustrate a prior art method of aligning a TSA mast assembly 208 in a first degree of freedom 213 towards a vertical axis 206 perpendicular to the horizon. In this example, mast 201 has a distal end portion 205 on which the dish (not shown) is mounted and a proximate end portion 210 that is pivoted and adjustably held within a bracket 203. Bracket 203 in turn is mounted on a vertical wall or similar structure 202, and thereby supports thereon the entire mast assembly. In aligning the mast 201 with the vertical axis 206, a hand-held level 204 is placed against the mast and the angle at which the mast extends relative to the vertical axis 206 in a direction away from or toward the vertical surface 202 is adjusted until the perpendicular orientation is reached, as shown in FIG. 2B.

Figure 3A:
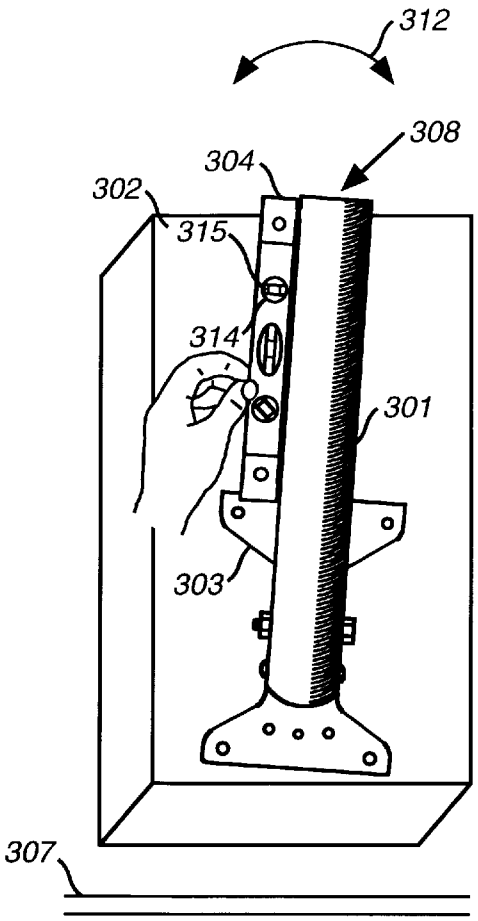
Prior Art FIG. 3(a)
FIGS. 3A, 3B and 3C illustrate a prior art method of aligning a TSA in a second degree of freedom, and show the mast out to the right of, in, and out to the left of, alignment.
Figure 3B:
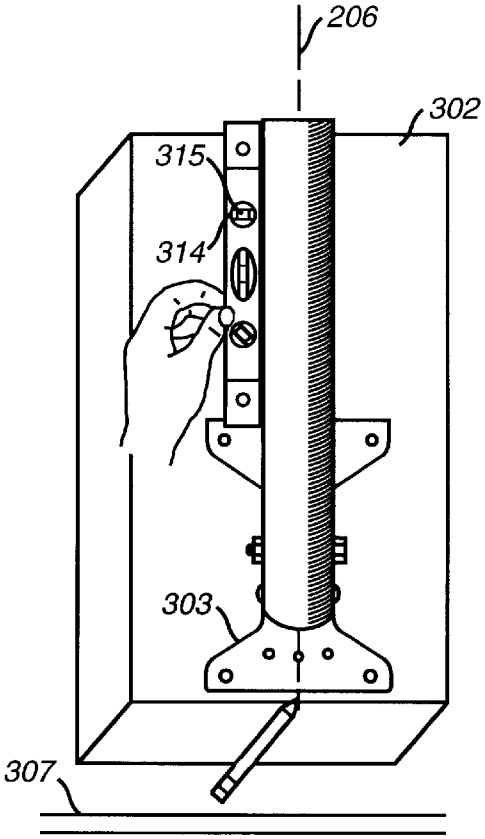
Prior Art FIG. 3(b)
Figure 3C:
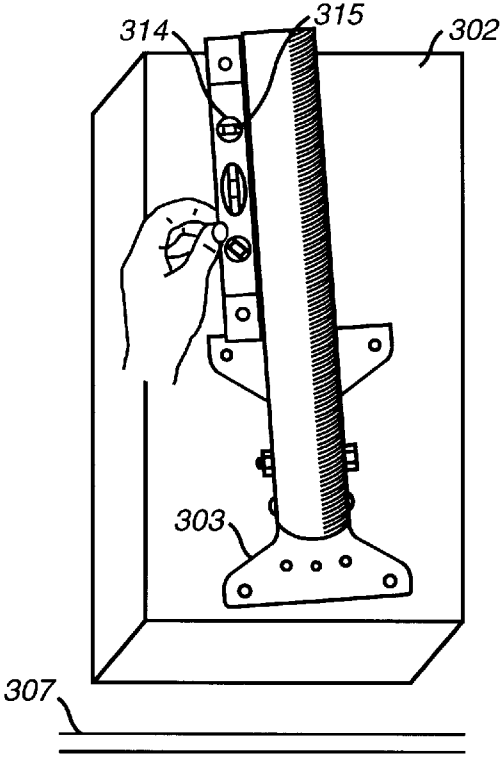
Prior Art FIG. 3(c)

In a similar fashion, FIGS. 3A–3C illustrate alignment of a TSA mast in a second degree of freedom 312 relative to the vertical axis 206, this degree of freedom being perpendicular to the first degree of freedom 213. In this case, base 303 must be rotated relative to the vertical surface 302 until mast 301 is aligned with the vertical axis 206, as shown in FIG. 3B. Proper alignment is indicated when bubble 315 is centered within the tube 314 of bubble level device 304, for the case where a bubble level is used as the handheld levelling device.

As discussed above and shown in detail in connection with FIGS. 2A–3C, the prior art methods for alignment of a satellite mast have required skillful use of external, handheld levelling devices in order to determine the proper degree of alignment of the satellite mast. The present invention avoids these difficulties by incorporating the levelling device directly within the housing of the satellite mast as shown in FIGS. 4A through 6.

Figure 4B:
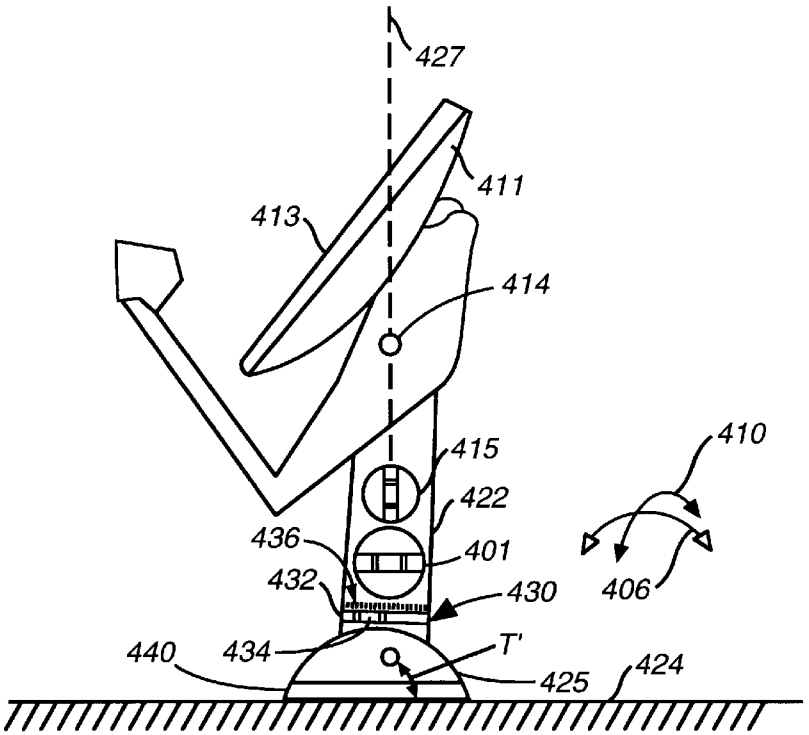
FIGS. 4A and 4B are elevational views showing a TSA with integral leveling means according to two different embodiments of the present invention.
Figure 4A:
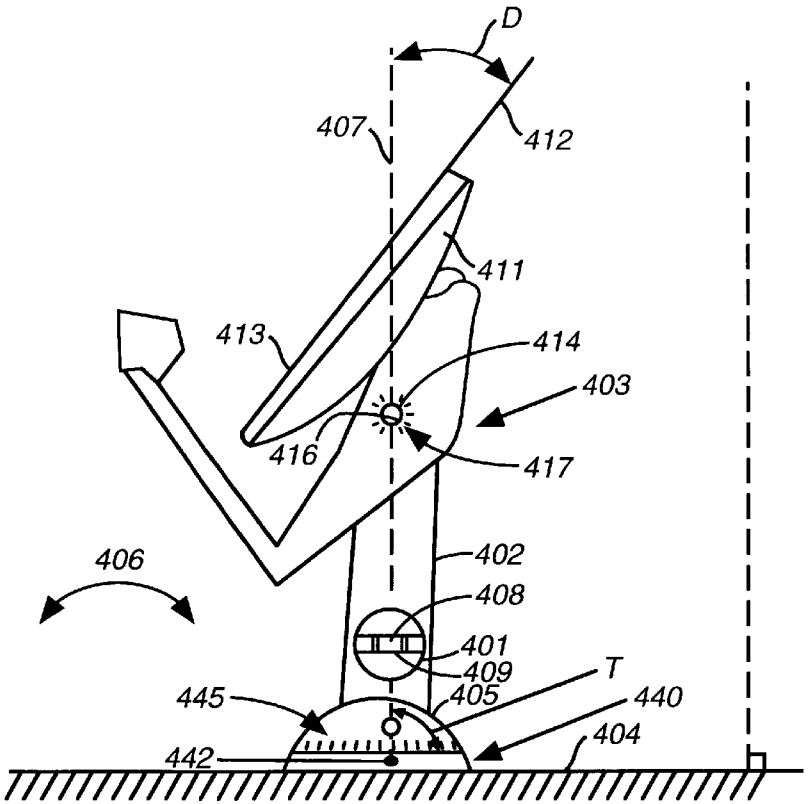

FIG. 4A shows a TSA 403 comprising an embedded level indicator, such as a bubble level device 401, which is permanently attached to mast 402 and has an air bubble 408 within a bubble tube 409. Since in this example, TSA 403 is mounted on the ground 404, alignment of TSA 403 is best facilitated when mast 402 is aligned vertically, i.e., perpendicular to the horizon, along a vertical axis represented by a broken line 407. To achieve the perpendicular position, the integral bubble level is used as a guide in adjusting the mast angle relative to the horizon. Thus, level 401 provides a constant "hands free" visual indication of the angle of the mast relative to the horizon in a plane constituting a degree of freedom represented by arrow 406.

The tilt angle T is the angle between the vertical axis 407 and the ground or other horizontal surface 404 and is preferably adjusted to be substantially a right angle (90°) by an adjustable bracket 405 in which is pivotally mounted the proximate end of the mast 402. When mast 402 is thus in vertical alignment with the vertical axis 407, it readily serves as a standard reference for the subsequent alignment of the receiver antenna dish 411 with the transmitter antenna 108 of the satellite 109. When mast 402 is leveled vertically, it may be rotated around vertical axis 407 by a universal connection with a horizontal pivot 414, or alternatively by means of a mounting device 440 on which bracket 405 is rotatably mounted.

Device 440 may include a pointer 442 for indicating the rotational position of dish 411 relative to an azimuth scale 445. After the center of receiver dish 411 is thereby placed in a common plane with the satellite transmitter dish, dish 411 may be elevated around pivot 414 until the two dishes are in proper alignment.

The elevation alignment of dish 411 may be achieved by adjusting the dish angle D between the mast axis 407 and the plane 412 as defined by the rim 413 around the face of the dish 411, dish 411 being mounted for pivotal movement around a pivot connection 414. Pivot connection 414 may include a pointer 416 for indicating the dish angle D along a scale 417 with degrees corresponding to the dish position. Since axis 407 is perpendicular to the horizon, the angles presented by scale 417 may have values corresponding to the range of angles traversable by the dish plane 412 relative to the horizontal surface 404.

FIG. 4B illustrates a second embodiment of the invention, wherein mast 422 includes two level sensors oriented ninety degrees apart on the same side of the mast, such as bubble levels 401 and 415, and an annular bubble indicator 430 extending circumferentially around at least part, and preferably all, of the periphery of mast 422. As described in connection with FIG. 4A, bubble level 401 provides a constant "hands free" visual indicator of the orientation of the mast when mounted in a substantially vertical position on a horizontal surface, such as the ground or a flat roof. On the other hand, second bubble level 415 provides a constant visual indication of the orientation of the mast when the mast is mounted in a substantially horizontal position, such as that of mast 104 shown in FIG. 1A. Both bubble levels are situated on the same side of mast 402 so that visual indication of alignment is easily viewable when alignment of the mast is desired either in the vertical plane of arrow 406 or in the vertical plane of arrow 410, which is perpendicular to the 406 plane. Optionally, bubble levels 401 and 409 may be situated on different sides of the mast 422.

Thus, the mast axis 427 of the FIG. 4B embodiment may be oriented either vertically, in which case 424 designates a horizontal surface, such as the ground, or horizontally, in which case 424 designates a wall or other vertical surface. The tilt angle T' is the angle between mast axis 427 and surface 424 and preferably is adjusted to be substantially 90°

(a right angle) by an adjustable bracket 425, in which is pivotally mounted the proximate end of the mast 422.

Annular bubble indicator 430 is usable in combination with bubble level 415 when mast axis 427 is oriented horizontally. Indicator 430 includes an annular tube 432 containing a bubble 434, and an adjacent scale 436 with an indicia of angles such that the position of bubble 434 along scale 436 gives an indication of the orientation of dish 413 around the horizontal axis 428.

Figure 5B:
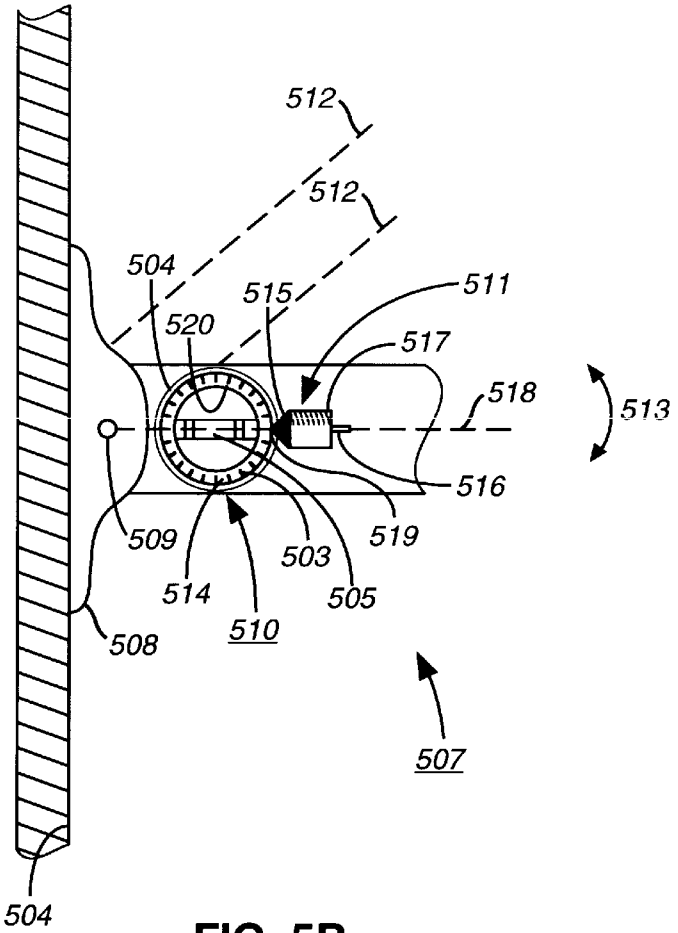
FIG. 5B is a fragmentary view of the TSA mast of FIG. 5A mounted on a vertical surface; and, FIG. 6 is a fragmentary view of the mast of a TSA of another embodiment of the present invention having integral levelling means capable of providing simultaneous level indication in two degrees of freedom.
Figure 5A:
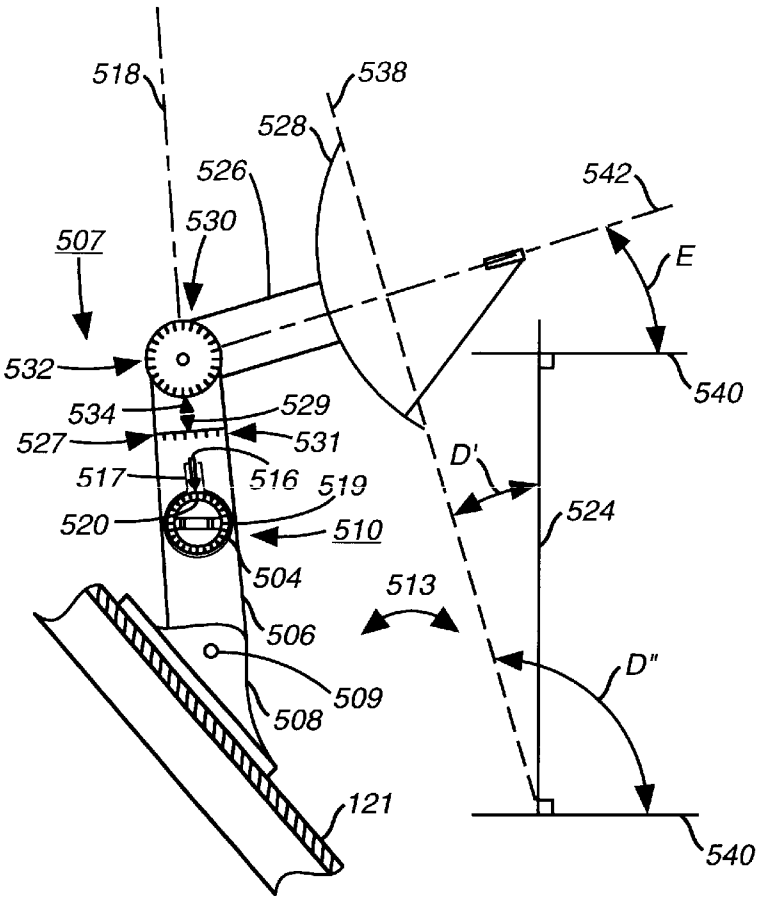
FIG. 5A is an elevational view of a TSA mounted on an angled surface and having adjustable leveling means according to a further embodiment of the invention.

Fig. 5A illustrates a third embodiment of the invention wherein adjustable bracket 508 is mounted on an angled surface, such as the roof 121 in FIG. 1C, so that mast 506 extends vertically instead of horizontally. Mast 506 includes a rotationally adjustable levelling device 510 having a bubble level 505 mounted within a rotatable disk 514, which is permanently housed so as to enable rotational movement within its own housing 504. Housing 504 in turn is either permanently or removably mounted in the tubular housing forming the mast 506.

As shown in FIG. 5B, mast 506 of a TSA 507 may also be mounted on a vertical surface 504 by the adjustable mounting bracket 508, thereby enabling mast 506 to extend horizontally and to be pivoted about the pivot 509 for tilting adjustment within the vertical plane of arrow 513, an upward tilted position of the mast 506 being indicated by the broken lines 512, 512. Pivot 509 may comprise a pivot pin, a nut and bolt combination, a universal joint, or the like, and extends horizontally to define a pivot axis.

The levelling device 510 and its housing also include a detent mechanism 511 comprising a spring loaded pin 516 mounted on mast 506 by a guide bracket 517, and one or more notches in the surface of rotatable disk 514 to establish one or more selected orientations of the levelling device relative to the axis 518 of mast 506. For example, there may be a first detent position 519 wherein the levelling device is oriented parallel with the mast axis 518 (FIG. 5B), and a second detent position 520 wherein the leveling device would be oriented perpendicular to the mast axis 518 (FIG. 5A). When installing the mast, therefore, the installer can select between a desired horizontal and a desired vertical orientation of the mast by simply rotating the disk 514 of the single levelling device 510 on the mast. Other detent positions between parallel and perpendicular may also be provided, as represented by the other sequential notches around the periphery of rotatable disk 514.

In the example of FIG. 5A, bubble level 505 of levelling device 510 is rotated relative to the mast until selecting, for example, a horizontal orientation as determined by operation of detent 511 to cause pin head 515 to snap into engagement with the notch at detent position 520. Then, mast 506 is pivoted about pivot 509 until the levelling device 510 indicates the proper levelled position where mast axis 518 is parallel to the vertical direction represented by arrow 524. Pivot 509 is then tightened, as by a wing nut (not shown), to retain the mast in the proper vertical orientation.

Although arm 526 may be connected to mast 506 by a universal elbow of the type described in connection with FIGS. 1A–1C, the preferred embodiment shown utilizes a separate mast rotating device 527 in combination with a planar (bidirectional) elbow device 530. Device 527 may include a pointer 529 for indicating the position of dish 528 relative to an azimuth scale 531.

With mast 506 thereby set in its vertical and rotational (azimuth) reference position, the articulated arm 526 supporting antenna dish 528 is then adjusted to its proper angle of elevation for receiving satellite signals by an adjustable elbow device 530 having angle indicia along a scale 532 that is readable relative to a pointer mark 534. When the dish 528 is properly aligned, a securing wing nut or the like (not shown) is tightened to fix the angular setting of arm 526.

Similar to the scale 417 of FIG. 4A, the angles presented by the indicia of scale 532 may have values corresponding to the range of angles traversable by the dish plane 538 relative either to the dish angle D' between plane 538 and vertical axis 524 or to the dish angle D" between plane 538 and the horizon 540, plane 538 being defined by the rim around the face of dish 528. Because of the geometry present when mast axis 518 is parallel to vertical axis 524 and the axis 542 of arm 526 is perpendicular to dish plane 538, the angle E between the arm axis 542 and the horizon 540 is equal to the dish angle D' between dish plane 538 and vertical axis 524.

Figure 6:
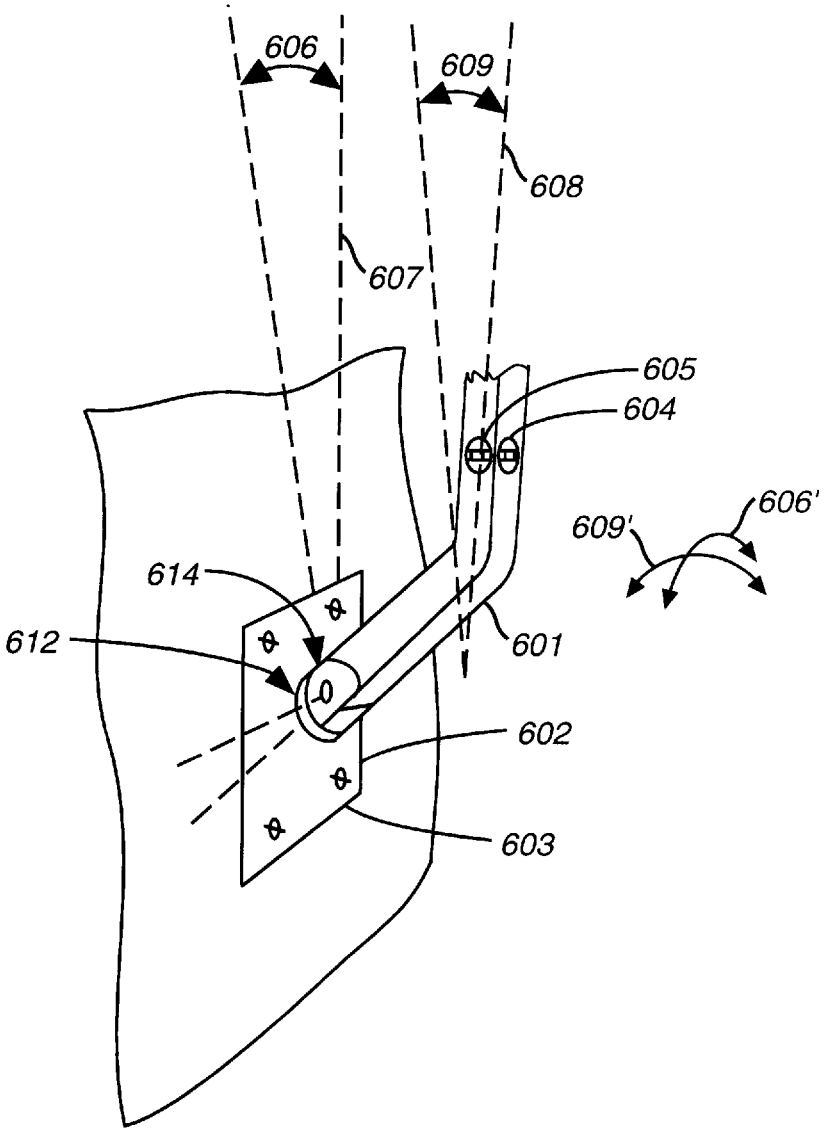

As a further embodiment of the present invention, the TSA mast may incorporate two or more levelling devices on adjacent sides of the mast in order to further facilitate alignment of the mast perpendicular to the horizon, such as the mast 601 shown in FIG. 6. In this figure, alignments in two degrees of freedom, as represented by arrows 606 and 609 relative to the respective vertical axes 607 and 608, may be simultaneously viewed by observing the bubble within both of the levelling devices 604 and 605 on adjacent sides of mast 601. Of course, in a further embodiment of the invention (not shown), each of the levelling devices 604 and 605 may comprise the double levelling devices of FIG. 4B or the selectable levelling device of FIGS. 5A and 5B.

As indicated by the floating set of arrows 606' and 609', the two degrees of freedom in this embodiment are perpendicular to each other. However, this need not be the case, such as where a mast is three sided and has a levelling device on each side. Rotation in the plane of arrow 606 is provided by a turntable device 612, while pivotal movement in the plane of arrow 609 is provided by a pivot device 614.

While this invention had been described in conjunction with specific embodiments, many alternatives, modifications and variations will be apparent to those skilled in the art when they learn of this invention. For example, although the preferred embodiments of the invention have been described in terms of bubble level devices for indicating the orientation of the antenna mast, the present invention may utilize any level indicating means that may be mounted on or embedded in the antenna mast housing, including (but not limited to) electronic or digital level sensors and the like. Although the invention has been described specifically with reference to terrestrial satellite antennas, it is also applicable to alignment of any terrestrial antenna for transmitting or receiving electromagnetic radiation. Accordingly, the preferred embodiments of the invention as set forth above are intended to be illustrative and non-limiting, the scope of the invention being defined only by the claims set forth below.

What is claimed is:

1. An antenna system comprising:

a base adapted to be mounted on a support surface;

a mast connected to said base;

an antenna assembly connected to said mast, said mast being adjustable relative to said supporting surface to provide a plurality of degrees of freedom such that an axis of said mast may be positioned at a selected orientation relative to the horizon in each of said degrees of freedom;

at least two lengthwise bubble level indicators positioned perpendicularly to each other mounted to said mast so that the respective bubbles in said bubble level indicators provide indications that said base is levelly mounted to said support surface irrespective of the orientation of said surface relative to said horizon; and an annular bubble tube mounted about said mast, a bubble in said annular bubble tube indicating the rotational position of said antenna assembly relative to the axis of said mast.

2. The system of claim 1, wherein said two level indicators are each mounted on a corresponding one of two adjacent sides of said mast for indicating alignment of said mast axis relative to support surface.

3. The system according to claim 1, wherein said antenna assembly comprises an arm, and an elbow device for adjustable connecting one end of said arm to a distal end of said mast, said elbow device comprising an angle indicator for indicating an angular value related to an angle between an axis of said arm and the longitudinal axis of said mast.

4. The system according to claim 1, wherein said antenna assembly comprises a dish having a face for receiving electromagnetic radiation from a direction perpendicular to an orientation plane of said face, and wherein said system further comprises an adjustable connection for adjustably connecting said dish to a distal end of said mast, said adjustable connection comprising an angle indicator for indicating an angular value related to an angle between said orientation plane of said dish and the longitudinal axis of said mast.

* * * * *